US009326555B1

(12) United States Patent
McKee

(10) Patent No.: US 9,326,555 B1
(45) Date of Patent: May 3, 2016

(54) WORKER KNEE PADS WITH TOOL POCKETS SUCH AS FOR ROOFERS AND FLOORING INSTALLERS

(71) Applicant: Steven McKee, Harpers Ferry, IA (US)

(72) Inventor: Steven McKee, Harpers Ferry, IA (US)

( * ) Notice: Subject to any disclaimer, the term of this patent is extended or adjusted under 35 U.S.C. 154(b) by 187 days.

(21) Appl. No.: 14/010,912

(22) Filed: Aug. 27, 2013

Related U.S. Application Data

(60) Provisional application No. 61/693,515, filed on Aug. 27, 2012.

(51) Int. Cl.
*A45F 5/00* (2006.01)
*A41D 13/00* (2006.01)
*A41D 13/06* (2006.01)

(52) U.S. Cl.
CPC ..... *A41D 13/0012* (2013.01); *A41D 13/065* (2013.01); *A45F 5/00* (2013.01); *A45F 2005/008* (2013.01)

(58) Field of Classification Search
CPC .... A45F 5/00; A45F 2005/008; A41D 13/065
USPC ..... 2/22, 24, 413, 455, 911; 128/878, 882; 602/23, 26, 62; 224/661, 219, 222, 267
See application file for complete search history.

(56) References Cited

U.S. PATENT DOCUMENTS

| | | | | |
|---|---|---|---|---|
| 4,425,912 | A * | 1/1984 | Harper | 602/26 |
| 4,561,123 | A | 12/1985 | Hull | |
| 4,613,991 | A | 9/1986 | Grover | |
| 5,014,636 | A * | 5/1991 | Seber | 112/419 |
| 5,687,422 | A * | 11/1997 | Wurst et al. | 2/24 |
| 6,058,505 | A | 5/2000 | Bettencourt | |
| 6,421,839 | B1 | 7/2002 | Vo et al. | |
| 6,584,616 | B2 | 7/2003 | Godshaw et al. | |
| 6,839,917 | B1 | 1/2005 | Landwehr | |
| 7,376,978 | B2 | 5/2008 | Godshaw | |
| D636,131 | S | 4/2011 | Johnson | |
| 2005/0082323 | A1 | 4/2005 | O'Hair | |
| 2009/0151039 | A1 | 6/2009 | Kielland | |
| 2010/0078100 | A1* | 4/2010 | Orton | 150/134 |
| 2012/0143292 | A1* | 6/2012 | Matsuo | 607/96 |
| 2012/0255097 | A1* | 10/2012 | Feuchs | 2/22 |

* cited by examiner

*Primary Examiner* — Khaled Annis
(74) *Attorney, Agent, or Firm* — McKee, Voorhees & Sease, PLC

(57) ABSTRACT

A knee pad assembly for work tasks requiring kneeling, including a knee pad, a method of attaching the knee pad to a user's leg, and a tool or accessory receiver attached or integrated to the knee pad. The tool or accessory receiver provides easy and convenient access to tools or accessories at the knee of the worker.

15 Claims, 3 Drawing Sheets

WORKER KNEE PADS WITH TOOL POCKETS SUCH AS FOR ROOFERS AND FLOORING INSTALLERS

CROSS-REFERENCE TO RELATED APPLICATIONS

This application claims priority under 35 U.S.C. §119 to the following provisional applications: Ser. No. 61/693,515 filed Aug. 27, 2012, which are incorporated by reference in their entirety.

BACKGROUND OF THE INVENTION

Field of the Invention

The present invention relates to knee pads such as are used by roofers or flooring installers, carpentry and for analogous uses. In particular, the invention relates to knee pads that can be independently installed at the worker's knees and then removed at the worker's discretion.

Problems in the Art

There are many tasks that benefit from cushioned or protective knee pads to reduce discomfort or injury to workers that have to kneel while performing the task. One example is U.S. Pat. No. 6,058,505 to inventor Bettencourt issued in 2000. This reference is incorporated by reference. It shows a main knee pad body with cushioning which is strapped around the backside of the knee. The worker can put those on when needed and remove and store them when not.

An alternative to knee pads would be some sort of pad or device that is placed on the floor or surface supporting the worker. An example is U.S. Design Pat. No. 636,131 to inventor Johnson, incorporated by reference herein. An issue with these type of mat-like devices is they must be moved manually each time the worker's position changes. They are also not convenient to carry around or store.

A still further option is work clothing such as work pants that have built-in knee pads or cushions. An example is U.S. Pat. No. 4,613,991 to inventor Grover issued in 1985, incorporated by reference herein. As can be seen, Grover has zippered pockets at the knee area into which cushion material can be installed.

Examples of tasks that benefit from knee pads of the above type include, but are not limited to, roofers, flooring or carpet installers, or the like. An occasional task such as gardening could also benefit from these devices. It is, of course, typical that any such tasks involve use of tools or accessories.

The conventional method of handling tools would be either some sort of tool belt worn at the waist, or a tool box or carrier that is carried and moved from location to location. Work pants or overalls can also have pockets in which tools can be carried. See previously mentioned U.S. Pat. No. 4,613,991.

Johnson D636,131 suggests having recessed areas in the padding device to hold tools or materials. But the recesses are open chambers. Tools or supplies could easily fill it, especially if the device is moved.

The inventor has found that there are limitations and deficiencies with conventional ways to make tools accessible for tasks carried out on one's knees. Tool belts can be cumbersome and heavy which can lead to fatigue and hip and back pain if carried around all day. Moreover, when on one's knees it is not always convenient or possible to efficiently reach back and find the appropriate tool in a tool belt.

Similar issues exist with regard to pockets in work pants. The issue with work pants is exacerbated because to carry such tools means they would always be with the worker and could not be independently removed such as with a tool belt.

As with all work, efficiency is typically highly beneficial. Therefore, the inventor has discovered a frustration with the existing paradigm of carrying tools on a tool belt for tasks requiring the worker to be on the worker's knees.

A separate tool box or container, or the separate knee mat of Johnson D636,131 does not resolve such problems. While tools might be placed closer to one's hands when the worker is on his or her knees, it requires movement of the box or mat each time the worker moves. It also risks losing tools or parts.

The inventor therefore has identified a problem and a solution that addresses the deficiencies in the state of the art.

SUMMARY OF THE INVENTION

It is therefore a principal object, feature, aspect, or advantage of the present invention to provide an advance over or improvement in the state of the art.

Other objects, features, aspects, or advantages of the present invention include, but are not limited to:

a. a knee pad that has integrated with it tool or accessory carriers;

b. knee pads which can be independently removable, yet have capacity to carry tools or accessories;

c. a pair of knee pads which can include tool or accessory carriers and which can be the same for both knee pads or differ.

These and other objects, features, aspects, or advantages of the present invention will become more apparent with reference to the accompanying specification and claims.

DETAILED DESCRIPTION OF THE PREFERRED EMBODIMENTS

A. Overview

Figure 1:
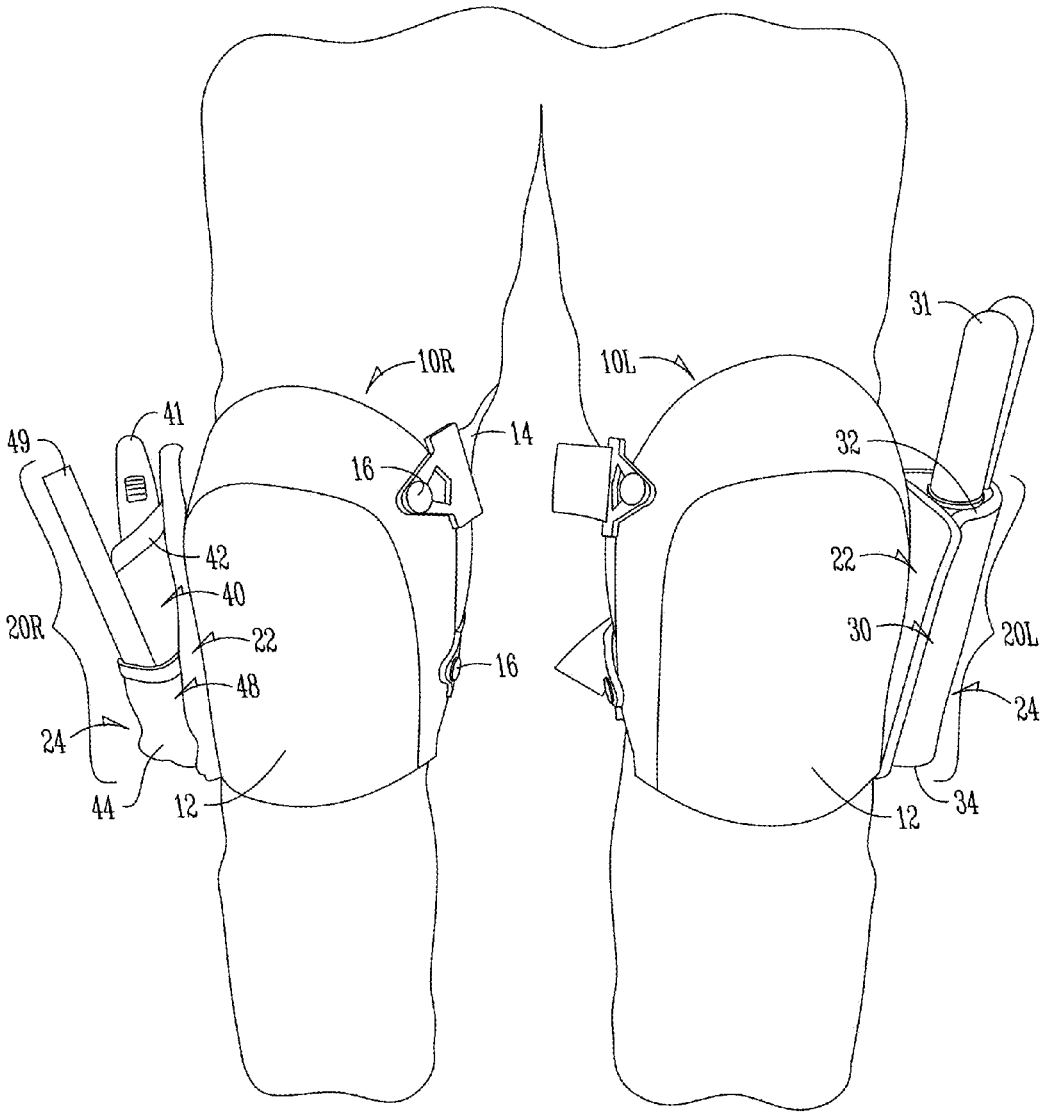
FIG. 1 is a perspective illustration of a pair of knee pads according to a first exemplary embodiment of the present invention on a worker from a perspective view.

In order to provide a better understanding of the invention, exemplary embodiments of different forms the invention might take are now described in detail. It is to be understood that these are exemplary only and not inclusive or exclusive of the different forms of embodiments the invention can take. For example, variations obvious to those skilled in the art will be included within the invention.

B. Exemplary Embodiment 1

With specific reference to the figures, a first exemplary embodiment includes a right knee pad assembly 10R and left knee pad assembly 10L that can have typical for conventional construction or roofing worker knee pad features and attachment. As seen in the figures, knee pad assemblies 10R and 10L have a cushion front over the knee cap and releasable straps to mount those pads to the worker's legs. The specific knee pad 12 and straps 14 can vary according to need or desire and can be similar to any number of presently commercially available sub-assemblies and therefore will not be discussed in any further detail here. As can be seen in the Figures, construction knee pads can come in a variety of forms and configurations that are commercially available, The only possible requirement for the present invention would be that the knee pad, the material comprising the knee pad, and the straps and fasteners for the straps be robust enough to maintain the knee pads attached to the user for normal circumstances experienced by such a worker and for the additional weight of the tools such as are described herein. Those tools in the Figures show tin snips, a utility knife, and a carpenter's pencil. However, other tools, accessories or supplies can be carried in pockets on the knee pads according to the invention, according to desire and/or need. It is to be understood that as a general rule, the tools or accessories carried on the invention will be of relatively light weight. For example, a hammer would still likely be carried on a tool belt.

Each knee pad assembly 10L and 10R includes a pocket sub-assembly 20L or 20R as shown in the figures.

For example, pocket sub-assembly 20L has a proximal side 22 (proximal to the user's leg when installed on the user). An opposite distal side 24 is away from the user's leg. A front side and a back side are relative to the front and back of the user's body.

In the embodiment shown in the figures, the pocket sub-assembly 20L is fastened at its proximal side 22 to the outer side of the knee pad 12L. In the figures, this is by rivets. It is to be understood, however, that any of a number of fastening methods are possible. One would be snaps to make the pocket sub-assembly 20L removable from the knee pad 12. But there are benefits to making sub-assembly 20L non-removable. For example, it can be sewn to the knee pad 12 or otherwise permanently connected if such is possible and practical relative to the type of material from which knee pad 12 (e.g. see stitches 50 at FIG. 3) and pocket sub-assembly 20L are made.

Figure 3:
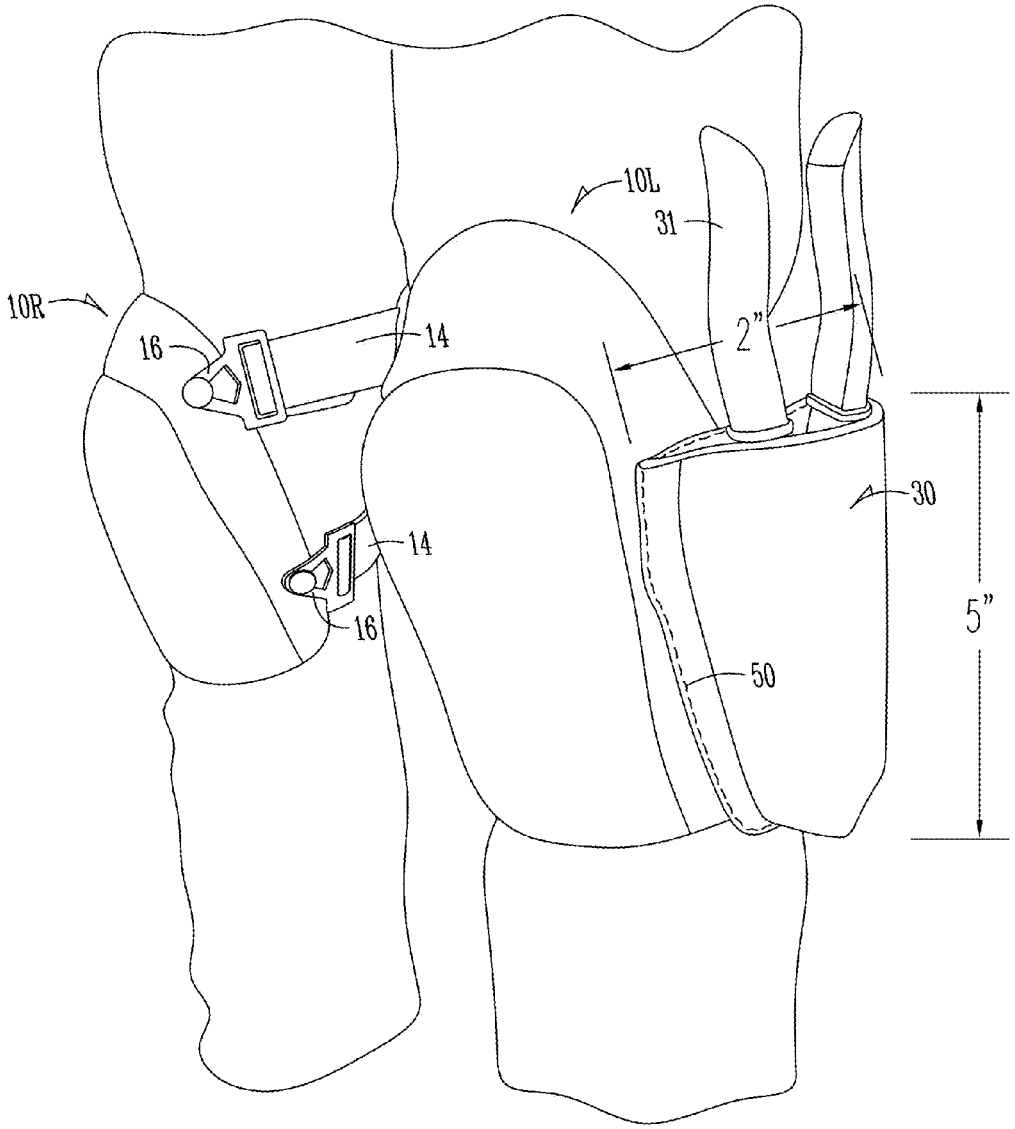
FIG. 3 is a perspective view of the left side knee pad of FIG. 1.

By referring to FIG. 3, it can be seen that pocket assembly 20L includes a large pocket or pouch 30. Such large pocket or pouch 30 has a closed bottom and closed side wall but an open top 32 (the bottom is shown at reference numeral 34).

In this embodiment, the open top allows for insertion of a tool or accessory 31 (in this example, tin snips). Of course any tool or accessory, including building materials, could be stored in pocket 30.

In this embodiment, the pocket has an access from open top to closed bottom that is vertical when the worker is standing up. When the worker kneels, that access would move towards horizontal. Thus, the handles of tool 31 would be easily accessible to the worker even when kneeling. They would likewise be easily accessible to the worker's hand when standing up.

Figure 2:
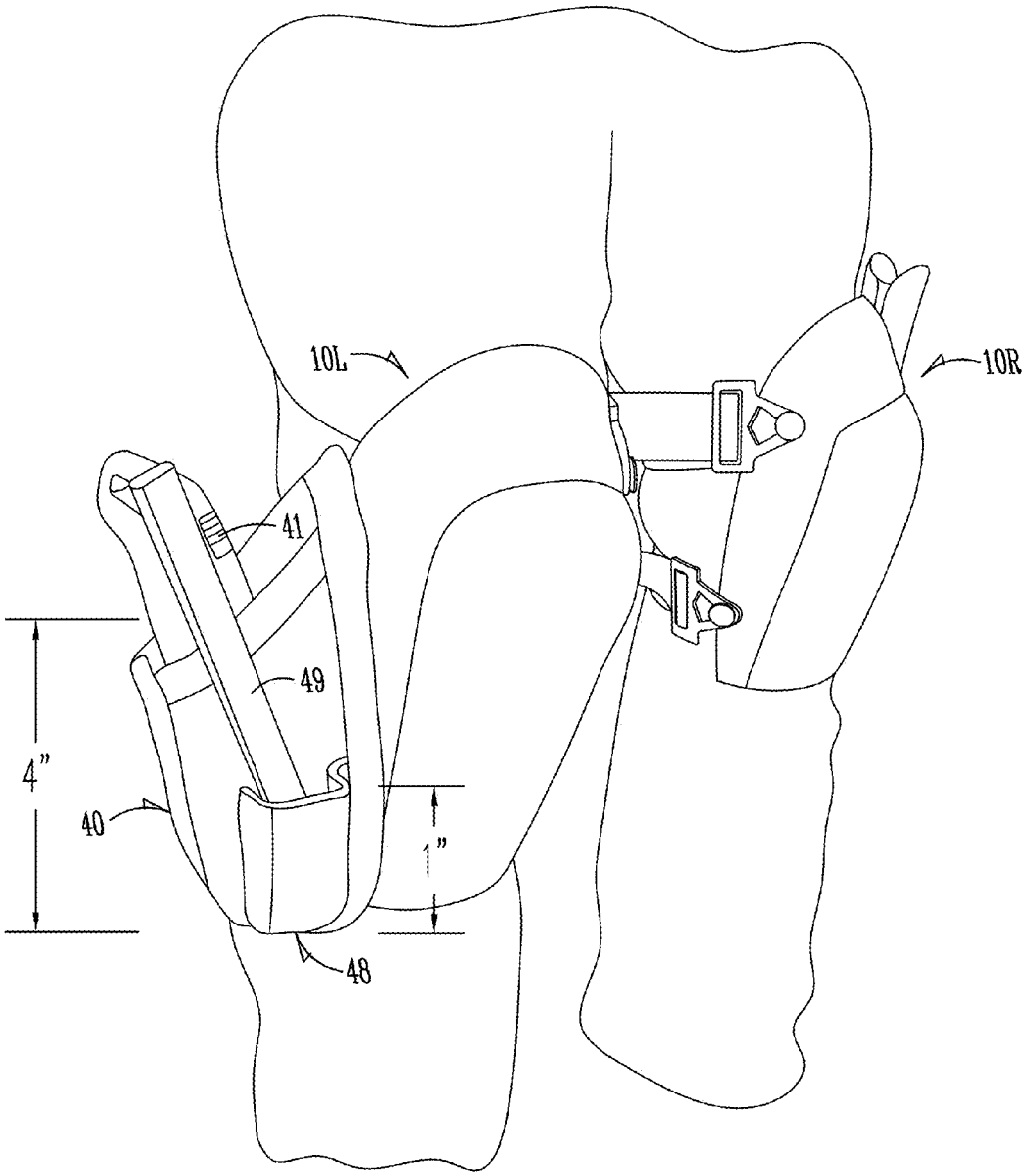
FIG. 2 is a perspective view of the right side knee pad of FIG. 1.

By referring to FIG. 2, pocket assembly 20R is shown in more detail. As can be seen, sub-assembly 20R has multiple pockets 40 and 48. This illustrates that the invention can have plural pockets (including more than two). It also shows that the pockets on one sub-assembly 20 can vary from the other sub-assembly 20.

As can be appreciated by those skilled in the art, the designer can make the configuration, size, location, and other features of each of the pockets according to need or desire. As shown in FIG. 2, the small pocket could contain a utility knife whereas the other pocket could contain a carpenter's pencil. Of course, other tools, accessories, or supplies could alternatively be placed in those pockets.

The designer would only be limited by the physical space available. Different knee pad assemblies 10 could be created for different tasks. In other words, a roofer's knee pad assembly could have different pockets than a carpet installer's knee pad assembly 10 or a gardener's knee pad assembly 10.

In this exemplary embodiment, knee pad assemblies 10L and 10R are designed for roofers and flooring personnel. They are focused on carrying light-weight tools or accessories. Heavier or more bulky tools or accessories could be transported in different ways including tool belt or tool box.

C. Exemplary Embodiment 2

As appreciated by those skilled in the art, each knee pad assembly 12L and 12R could be essentially mirror images of one another. This would make for a more efficient manufacturing. The designer could basically design a standard set of pockets or pouches and merely attach the identical pocket sub-assembly 20 to each knee pad on opposite sides.

D. Options and Alternatives

Other embodiments of knee pad assemblies are contemplated and within the scope of the invention. For example, the specific size and configuration of knee pad, how it is attached, and number and arrangement of pouches and pockets can vary according to design or need.

Additionally, the construction of the assembly can vary. The figures show a flexible material such as a woven fabric for most of the main pieces would allow construction of the knee pad 12, straps 14, and pocket sub-assemblies 20. Stitching or rivets or other fasteners can fasten the different fabric sections. Knee pad cushioning material could be inserted and held in place between layers of the fabric. This sort of construction is shown at U.S. Pat. No. 6,058,505. As can be appreciated by those skilled in the art, the construction in the example in FIGS. 1-3 show snap-on pockets to the knee pads. A variety of different ways of attaching or building in the pockets to the knee pads are possible. One example would be a tuck and sew method. Another would be rivets. In any event, the designer would select a method of construction of pockets and knee pads which would be robust enough for the normal wear and tear and circumstances of use of these types of construction knee pads.

Alternatively, at least a substantial part of the assembly 10 could be made out of molded plastic. The pocket sub-assembly 20 could also be molded such that the whole unit could be substantially molded out of one piece. Again, one example of material would be a woven fabric that is robust for these circumstances. Other materials are possible.

The attaching members can be straps with snaps. The straps can be elastic or not. The straps also could have simply a metal or plastic loops and cinches. Velcro is also possible as an attachment method. Other methods are possible.

Combinations of materials (for example some molded, some fabric) are also possible.

Additionally, the size and orientation of pockets or pouches can vary according to design or need. Additionally, there might be or could be loops, hooks, snaps, or other hardware on the pocket sub-assembly 20 or knee pad assembly 10 that allow connection of accessories or tools.

Other options or alternatives or variations obvious to those skilled in the art are possible.

What is claimed is:

1. A knee pad assembly, comprising:

a. a cup-shaped padded knee pad having superior, inferior, medial, and lateral sides, when worn in an upright position;

b. first and second straps having first ends fixedly attached at spaced apart positions at one of the medial and lateral sides and second ends including fasteners releasably connectable at spaced apart positions at the other of the medial and lateral sides of the knee pad for removably mounting the knee pad over a user's knee-cap;

c. a tool or accessory holder pocket sub-assembly directly coupled to the kneepad at the lateral side of the knee pad comprising at least one pocket defining an enclosed space between an access opening towards the superior side of the knee pad and a closed end towards the inferior side of the knee pad, the pocket having a length between the opening and the closed end longer than a width of the at least one pocket;

wherein the at least one pocket is adapted to be disposed at a lateral side of a knee of the wearer when the knee pad is worn.

2. The knee pad assembly of claim 1 wherein the pocket sub-assembly comprises multiple pockets.

3. The knee pad assembly of claim 2 wherein the multiple pockets are of different size or configuration.

4. The knee pad assembly of claim 2 wherein the multiple pockets are side-by-side, each with an opening near the superior side of the side of the knee pad.

5. The knee pad assembly of claim 1 in combination with a second knee pad assembly.

6. The knee pad assembly claim 5 wherein the pocket sub-assembly for the knee pad assembly comprises at least one receiver for a tool or accessory and the pocket sub-assembly for the second knee pad assembly comprises the same receiver.

7. The knee pad assembly claim 5 wherein the pocket sub-assembly for the knee pad assembly comprises a first receiver for a tool or accessory and the pocket sub-assembly for the second knee bad assembly comprises one or more different second receivers for tools or accessories.

8. The knee pad assembly of claim 1 further comprising a kit having a pair of knee pad assemblies in packaging.

9. The knee pad assembly of claim 8 further comprising one or more tools in the kit.

10. The knee pad assembly of claim 1 comprising molded plastic.

11. The knee pad assembly of claim 10 wherein the knee pad and pocket sub assembly are one piece molded plastic.

12. A set of knee pad assemblies for use by roofers and other workers comprising:

a. each knee pad assembly comprising a housing with a cupped padded knee pad having superior, inferior, medial, and lateral sides when worn in an upright position; and first and second straps having first ends fixedly attached at spaced apart positions at one of the medial and lateral sides and second ends including fasteners releasably connectable at spaced apart positions at the other of the medial and lateral sides of the knee pad for removably mounting the knee pad assembly over a user knee-cap; and b. each housing including a pocket sub-assembly directly coupled to the kneepad at the lateral side, the pocket sub-assembly comprising one or more pockets each defining an enclosed space between an access opening towards the superior side of the housing and a closed end towards the inferior side of the housing;

wherein the one or more pockets are adapted to be disposed at a lateral side of a knee of the wearer when the knee pad is worn.

13. The set of knee pad assemblies of claim 12 wherein the one or more pockets comprise two pockets side-by-side both with openings on the superior side of the housing.

14. The set of knee pad assemblies of claim 12 wherein the one or more pockets comprises two pockets that at least partially overlap one another.

15. The set of knee pad assemblies of claim 12 in combination with one or more tools in one or more of the pockets.

* * * * *